United States Patent [19]

Van Vliet

[11] 4,122,582

[45] Oct. 31, 1978

[54] FIBER MAT FORMING MACHINE

[75] Inventor: Raymond A. Van Vliet, Castle Rock, Wash.

[73] Assignee: Weyerhaeuser Company, Tacoma, Wash.

[21] Appl. No.: 758,612

[22] Filed: Jan. 12, 1977

[51] Int. Cl.[2] ..... D01G 5/00

[52] U.S. Cl. ..... 19/65 R; 19/96; 19/304

[58] Field of Search ..... 19/155–156.4, 19/82, 83, 86, 88, 89, 96, 65 R; 425/80–83; 156/62.2, 62.4

[56] References Cited

U.S. PATENT DOCUMENTS

| | | | |
|---|---|---|---|
| 2,635,301 | 4/1953 | Schubert | 19/156 |
| 3,824,652 | 7/1974 | Buell | 19/83 X |
| 3,894,315 | 7/1975 | Fukuta | 19/83 X |

FOREIGN PATENT DOCUMENTS

| | | | |
|---|---|---|---|
| 1,078,727 | 8/1967 | United Kingdom | 19/83 |

*Primary Examiner*—Dorsey Newton

[57] ABSTRACT

A soft, loosely compacted mat of fibers is continuously formed atop a traveling conveyor. The fibers are deposited on top of the screen from an air-fiber flow within a suitably sized conduit having the same width as the desired width of the mat. A fiberizer is upstream from the mat-laying station and serves to fiberize sheets of incoming fiber. A plurality of sheets can be fiberized and as they are fiberized, the flow is entrained with air with differential pressures throughout the flow path from the fiberizing station to the conduit and mat-laying station. The structure of the fiberizer allows fiber sheets to be fiberized and then directs the fibers toward an adjustable diverging portion of the fiberizer shell from where the air-fiber mixture flows toward the mat-laying station. Variable mat widths can be formed by varying the conduit width and by varying the lateral dimension of the diverging portion of the fiberizer shell.

4 Claims, 2 Drawing Figures

FIBER MAT FORMING MACHINE

BACKGROUND OF THE INVENTION

This invention relates generally to the formation of loosely compacted fiber mats and, more particularly, to a machine for improving the uniformity of the mat as it is continuously formed.

Fibrous mats have been formed from compact fiber sheets on known machines for many years. One known procedure and machine comprises a device such as a pin-mill which has a rotor with a substantial number of sharp pins mounted about the periphery and enclosed by an outer shell. Incoming compacted fiber sheets, such as pulp sheets, are caused to impinge upon the passing pins, whereby the compacted fiber sheet is converted into individual fibers or small clumps of fibers and is then substantially in an air-fiber mixture within the annular volume between the pins and the shell. The air-fiber mixture is then directed through a conduit exiting from the shell to a typical mat-laying station, which may be comprised of an endless foraminous screen with a suction box beneath the screen. The fibers remain on the foraminous screen and will form a loosely compacted mat of fibers. One such use of a typical fiberizing and mat-layig machine is to convert incoming pulp sheets to a continuous fluff mat, which would then be suitable for cutting into desired lengths for use in diapers. A typical commercially available machine suitable for fiberizing pulp sheets and for laying down a loosely compacted mat is one available from Curt G. Joa, Inc. of Sheboygan Falls, Wisc. These known machines are capable of fiberizing a plurality of incoming compacted fiber sheets with the number varying dependent upon the thickness, width and density of the loosely compacted mat to be formed.

One of the problems in known machines is that when incoming compacted fiber sheets have widths that are greater than the loosely compacted mat width to be formed, the fiberizing process together with use of a converging duct tends to result in a nonuniform mat density and/or one which is very uneven requiring a typical scalping spinner or comb for leveling. Typically, scalping degrades some of the fiber and reduces the interlocking bonds of much of the fiber. Clumps of fibers are sometimes displaced, resulting in holes or thin areas within the mat. As will be recognized by those skilled in the art, holes or thin areas can degrade the mat to such an extent that certain sections become unusable and therefore result in a significant amount of waste and/or additional processing time to cut out the unacceptable portion of the mat. The known machines simply provide converging ducts leading from the fiberizer housing and it has been found that simple converging ducts do not provide the uniformity required to result in continuously produced uniform mat properties.

Accordingly, from the foregoing, one object of the present invention is to provide an air-fiber mixture that will result in a continuously formed mat having uniform thickness and density over the desired width.

Another object of the present invention is to provide a fiberizing machine capable of generating air-fiber mixtureshaving variable widths while maintaining the uniform density across the width and thereby within the formed mat.

A further object of this invention is to provide a machine that is of simple construction, high reliability and simple in operation.

Yet another object of this invention is to provide an improvement that may be incorporated within existing fiberizing machines and at low cost.

These and other objects will become more apparent and better understood upon reading the specification to follow in conjunction with the attached drawings.

SUMMARY OF THE INVENTION

Briefly, this invention is comprised in one form of a machine for fiberizing compacted fiber sheets and forming therefrom an air-fiber mixture that is structured to have a uniform density over its width such that when the mat-laying station is reached, a loosely compacted mat having the desired width will be formed with the desired density and thickness over its width. The improvement is comprised of a diverging section within the shell of the fiberizing machine with the divergence beginning at the fiberizing station and extending circumferentially radially outward toward the top of the machine shell. The diverging section then opens into a conduit that is of a width equal to the mat width to be layed. Another feature of the invention is that the diverging section is adjustable, depending upon the desired width of the air-fiber mixture to be formed and thereby the width of the mat to be layed down. Pressure gradients serve to direct the fibers from the fiberizing station transversely inward toward the diverging section, while at the same time the suction applied at the mat-laying station tends to draw the fibers from the high-pressure region at the fiberizing machine toward the low-pressure region at the mat-laying station. This structure with the pressure gradients serves to generate a uniform air-fiber mixture within the fiberizing machine before the mixture passes into the conduit for passage to the mat-laying station.

DESCRIPTION OF THE PREFERRED EMBODIMENT

Figure 1:
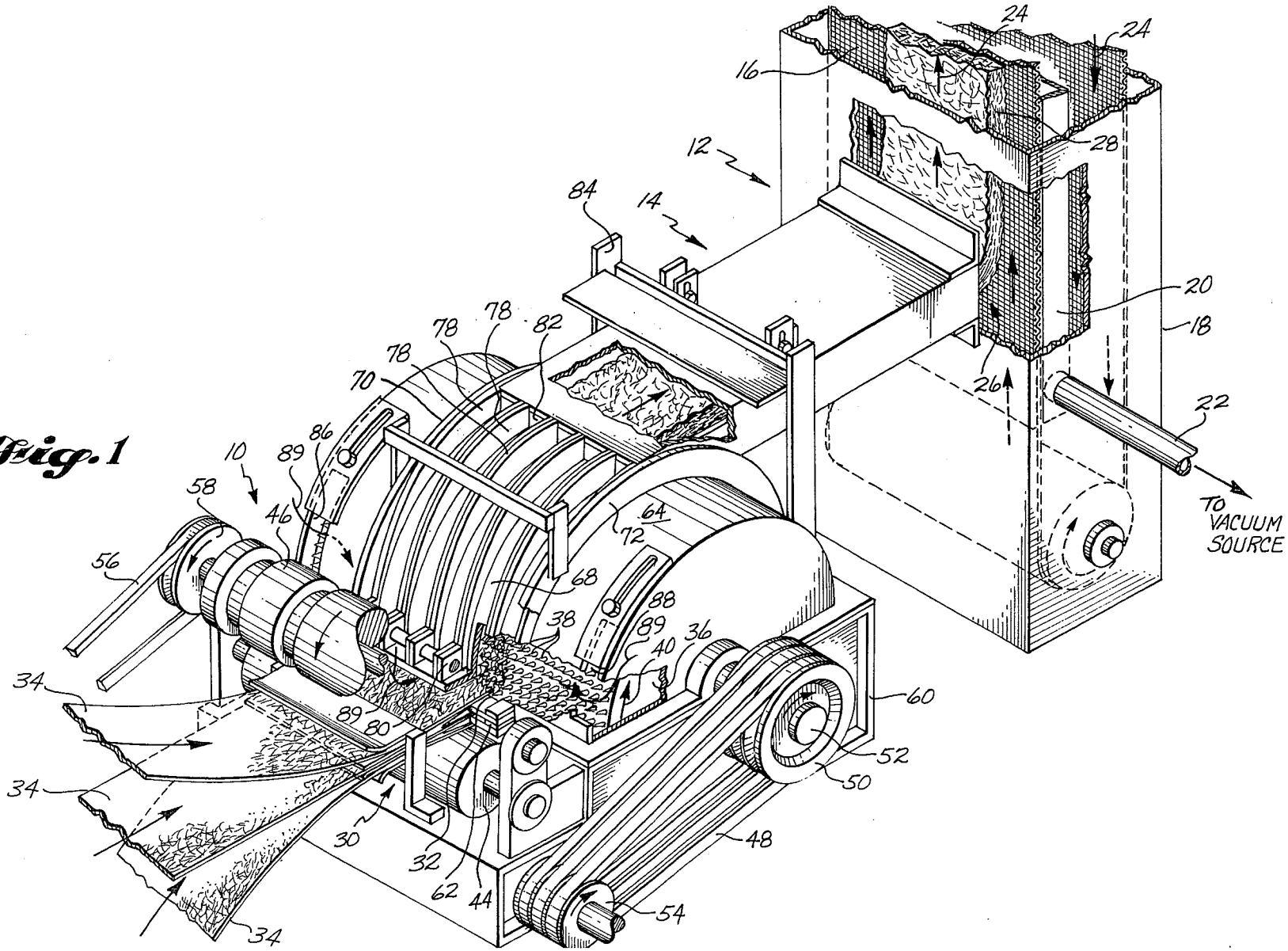
FIG. 1 is a perspective view partly cut away at selected locations showing the incoming compacted fiber sheets being fiberized in the fiberizing machine and the air-fiber mixture then being formed and directed to the mat-laying station.

Inasmuch as the present invention represents an improvement for a known machine, the known machine will be generally described first with a more specific description then being given of the improvement structure and operation. Referring first to FIG. 1, the general known machine system is comprised of a fiberizing machine generally indicated at 10, a mat-laying machine generally indicated at 12, and a conduit generally indicated at 14, extending therebetween.

Mat-laying machine 12 is typical in that it is comprised of an endless foraminous conveying screen 16 enclosed within enclosure 18 and is generally vertically oriented. A typical vacuum box 20 is disposed adjacent the interior face of foraminous screen 16 and through vacuum conduit 22 is connected to a vacuum source (not shown). The directional arrows 24 indicate that the foraminous screen 16 is traveling vertically upward at a mat-laying station generally indicated at 26. As the foraminous screen 16 travels past mat-laying station 26 and with the applied pressure differential across screen 16, an air-fiber mixture directed against foraminous screen 16 will allow a loosely compacted mat of fibers to be laid atop the screen. By continuously directing an air-fiber mixture against a continuously traveling screen 16, a continuous mat 28 will be formed. It is mat 28 that is comprised of loosely compacted fibers with the mat having a predetermined width and ideally a uniform density and thickness over the width. As the continuous mat 28 travels upward, it would then undergo other handling and processing steps in forming useful end products such as diapers.

The conduit 14 extending between fiberizing machine 10 and mat-laying machine 12 has a uniform width throughout its axial length. Of course conduit 14 opens into enclosure 18 at the mat-laying station 26.

The fiberizing machine 10 is typical in that it is comprised of an infeed section generally indicated at 30 and a fiberizing station generally indicated at 32. Fiberizing station 32 can be of any suitable type that functions to reduce compacted incoming fibrous sheets 34 into individualized fibers, positioning them in a transversely extending volume comprised of an air-fiber mixture.

Figure 2:
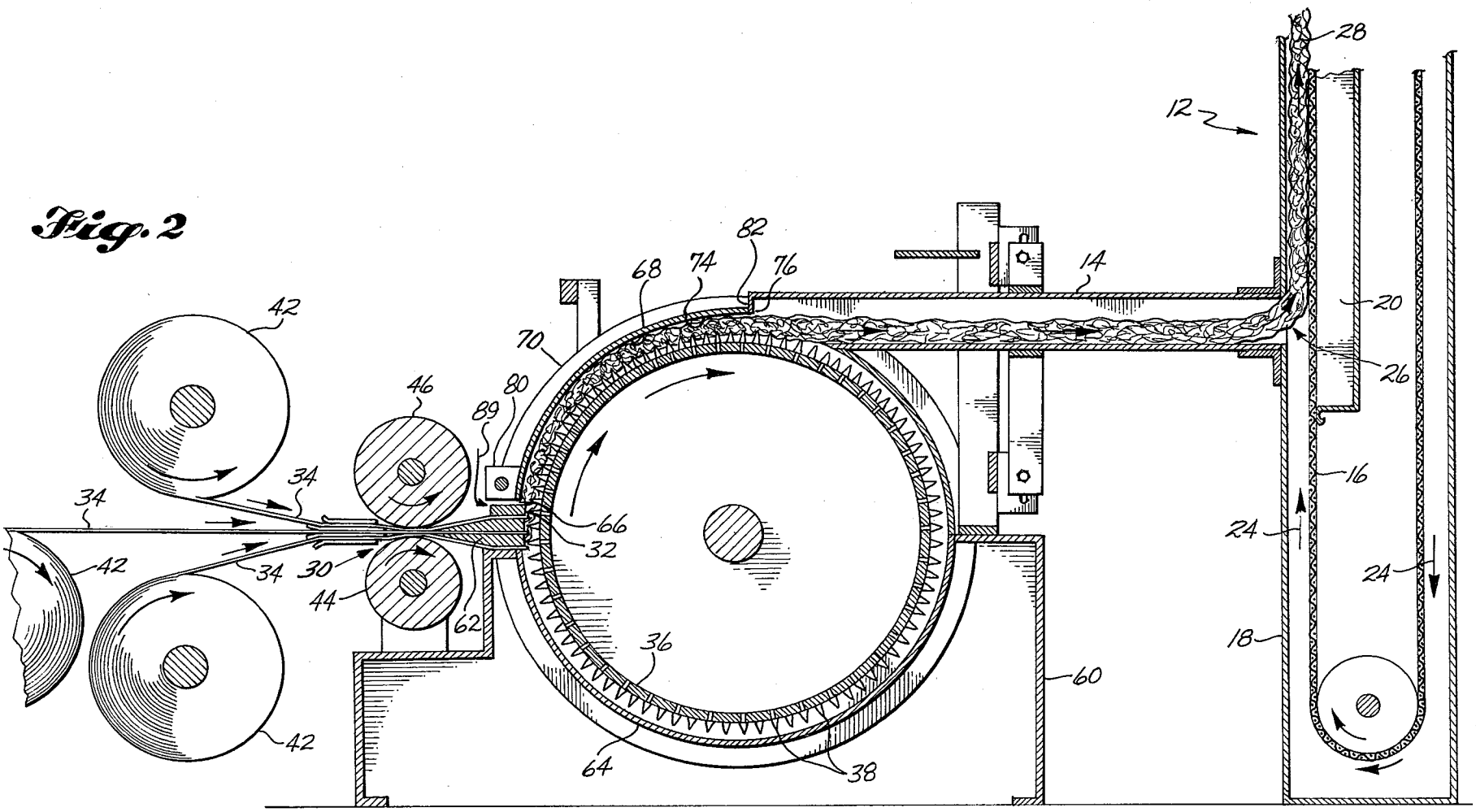
FIG. 2 is a cross-section through the fiberizing machine and mat-laying station showing the fiberizing process and also showing the diverging section of the shell structure.

In the particular embodiment depicted, the fiberizing machine is a typical pinmill, having a rotating cylinder or rotor 36 with a plurality of individual pins 38 spaced about the periphery. The directional arrows 40 on FIGS. 1 and 2 indicate that the rotating cylinder 36 turns in a clockwise direction moving upwardly past the fiberizing station. The typical pinmill may be fed from a plurality of individual rolls 42 of compacted fibrous sheet material which are positioned upstream of infeed section 30, such that as each sheet 34 is fed into infeed section 30, they will be vertically spaced from one another. As previously noted, the number of incoming fiber sheets is determined primarily by the desired characteristics of the loosely compacted fibrous mat and generally if a more dense mat is desired, a greater number of fiber sheets 34 will be fed through infeed section 30. The fiberizing machine 10 depicted in the figures shows the capability of feeding three such sheets 34 into fiberizing station 32. Serving to positively convey fiber sheets 34 into fiberizing station 32 is a pair of vertically spaced feed rolls 44, 46. The fiber sheets 34 pass between rolls 44, 46 and the rolls are driven in the direction indicated to feed sheets 34 into fiberizing station 32. Serving to drive rotating cylinder 36 are drive belts 48 which are trained about pulleys 50 which are in turn fixed to the end of rotatable shaft 52 supporting cylinder 36. Belts 48 are driven by pulleys 54 which are in turn driven by any suitable motor (not shown). Serving to turn rolls 44, 46 is drive belt 56 trained about pulley 58. Rolls 44, 46 are meshed through suitable gearing (not shown) so as to rotate at the same speed and in the proper feeding direction. Serving to support fiberizing machine 10 and the various rotatable shafts in their proper spatial relationships with respect to the other elements and to mat-laying machine 12 is the frame structure indicated at 60.

At fiberizing station 32 a typical three-opening breaker bar structure 62 functions to present the incoming fiber sheets 34 to the continuously passing individual pins 38. Enclosing the fiberizing machine generally is the cylindrical transversely extending shell 64. Shell 64 is likewise supported by frame structure 60 and serves to provide the small annular volume between the inside surface of shell 64 and the pins 38 within which the fiberization and air entrainment occurs prior to flow out of shell 64. Shell 64 totally encloses the rotating cylinder 36 and the individual pins 38 with certain selectively positioned openings which will be described shortly.

In a typical known fiberizing machine the rotating cylinder 36 would rotate opposite to that indicated by directional arrows 40 and would fiberize the incoming sheets such that the air-fiber mixture would be directed circumferentially in a downward direction to where a converging conduit would be positioned and opened to the shell at the bottom of the fiberizing machine.

Now a description will be given of the specific improvement in the fiberizing machine that allows a uniform air-fiber mixture to be formed within the fiberizing machine and prior to entering conduit 14. The three openings at breaker bar 62 extend transversely a distance that will be slightly greater than the largest sheet width to be accommodated. Positioned transversely along the top edge of the breaker bar assembly is air opening 66, which likewise is sized according to the largest incoming sheet width. Extending upwardly and circumferentially from air opening 66 is the diverging section 68 of shell 64. Diverging section 68 is of uniform transverse dimension for a given mat width but may vary, as will be described later. The diverging section 68 is spaced between a pair of transversely spaced rings 70, 72 attached to shell 64. Rings 70, 72 serve to support the diverging shell surface 74 as it extends circumferentially and increases in radial dimension. The interior diverging shell surface 74 increases in the radial dimension as it extends circumferentially from a point beginning at air opening 66 to a point terminating at an opening in shell 64 that coincides with inlet end 76 to conduit 14. As an example for a typical pinmill fiberizing machine, and one which is not intended to limit the scope of the present invention, a suitable change in dimension would be that for every 12 inches in circumferential distance the radial distance would increase 1 inch to form the diverging section. This divergence, although slight, may be seen by referring to FIG. 2. As previously noted, the interior width of the diverging section 68 coincides with the width of the mat to be layed down and is variable in order to produce different mat widths. The diverging section 68 is made variable by providing individually supported circumferentially extending radially variable surface elements, each indicated as 78. For a narrow width, the transversely outer surface elements 78 are adjusted so their interior surfaces are flush with the interior surface of shell 64. Serving to support each individual element 78 in its proper position is a bottom holding and support means 80 and a top holding and support means 82. The bottom means 80 may be comprised of, for example, a transversely extending shaft on which each element 78 is pivotally mounted. The top means 82 may be comprised of, for example, the tight friction fit between adjacent side walls of adjacent elements 78. If additional holding or support means are deemed necessary, they may include any suitable clamp mechanism.

Conduit 14 is supported in place to coincide with the interior exit dimensions of diverging section 68 by supporting frame 84 which is adapted to accept conduits of varying widths to coincide with the finally desired mat width as determined by the interior width of diverging section 68. Thus, the opening within conduit 14 will coincide with the size of the opening at the outfeed end of diverging section 68. Similarly, at the outfeed end of conduit 14 at mat-laying station 26, the structure of enclosure 18 is adapted to accept the variable width conduit for proper operation.

In order to control and properly generate the air-fiber mixture, the air flow within shell 64 must be carefully structured. A pair of adjustable openings 86, 88 transversely spaced on shell 64 and generally in line with the air opening 66 generate transversely moving air inwardly and toward the diverging section. The flow arrows 89 depict air being sucked into shell 64 through openings 86, 88 and through opening 66 and with the pressure differential existing between fiberizing machine 10 and mat-laying machine 12 together with the dynamic pressures created by the rotating cylinder 36 within shell 64, the air-fiber flow will be directed inwardly at the fiberizing station 32 toward the diverging section 68 where the air-fiber mixture will then be pulled circumferentially upwardly into the volume of diverging section 68 where it will enter conduit 14. Additional air flow can be provided at the inlet end 76 of conduit 14 if necessary to provide enough air for carrying the air-fiber flow toward mat-laying machine 12. By causing the air to flow inwardly toward the fiberizing station the air-fiber mixture that is being created is uniformly generated and maintains a uniform density as it is pulled upwardly within the diverging section and toward conduit 14. Additionally, by the inwardly directed air flow and the diverging section 68, if the fiberizing station 32 is fiberizing fiber sheets 34 that are of a greater width than mat 28, the inwardly directed air flow together with the diverging section will still yield a uniformly distributed air-fiber mixture for conveyancing through conduit 14 to foraminous screen 16. When three incoming sheets 34 are being fiberized, the adjustable openings 86, 88 are adjusted to allow for a decrease in incoming air so that the air-fiber mixture can support a higher percentage of fiber.

While a detailed description of an improved fiberizing machine and its operation has been given, it is to be understood that many changes and modifications may be made to the invention without departing from the inventive concept. All such modifications are intended to be included within the scope of the appended claims.

What is claimed is:

1. In a fiberizing machine of the type having a fiberizing station into which compacted fiber sheets are fed, a cylindrical transversely extending shell having an infeed opening at the fiberizing station and an opening circumferentially spaced from the infeed opening at the inlet end of a conduit extending outwardly from the shell, and a cylindrical rotor mounted within the shell and having means thereon for mechanically fiberizing incoming fiber sheets, said rotor and the inside surface of the shell defining a transversely extending annular volume within which an air-fiber mixture is formed at the fiberizing station and then flows circumferentially within at least a portion of the volume, the improvement comprising:

a portion of said shell diverging circumferentially outwardly from substantially adjacent the infeed opening and extending to a position substantially adjacent the inlet end of said conduit and terminating at the opening thereto, with the transverse dimension of said diverging portion being less than the transverse dimension of said shell.

2. The improvement as in claim 1 in which the diverging portion of said shell increases radially approximately one unit distance for every 12 units of circumferential distance.

3. The improvement as in claim 1 in which the diverging portion of said shell is comprised of a plurality of individual transversely extending elements with the number selected so as to generate a transverse dimension at the outlet thereto which dimension corresponds to the width dimension of said conduit.

4. The improvement as in claim 1 including adjustable air inlet openings positioned within the shell and spaced transversely from the ends of the infeed opening.

* * * * *